US008420960B1

(12) United States Patent
Ranta

(10) Patent No.: US 8,420,960 B1
(45) Date of Patent: Apr. 16, 2013

(54) DISCONNECT PULLOUT HANDLE

(75) Inventor: Michael John Ranta, Morton, IL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/239,965

(22) Filed: Sep. 22, 2011

(51) Int. Cl.
*H01H 9/00* (2006.01)

(52) U.S. Cl.
USPC ..... 200/17 R; 200/51.09

(58) Field of Classification Search ..... 200/43.04, 200/43.05, 17 R, 51 R, 51.09; 439/507, 511
See application file for complete search history.

(56) References Cited

U.S. PATENT DOCUMENTS

| | | | | |
|---|---|---|---|---|
| 4,826,443 | A * | 5/1989 | Lockard | 439/101 |
| 4,851,963 | A * | 7/1989 | Miller et al. | 361/643 |
| 5,270,500 | A * | 12/1993 | Guiney | 200/17 R |
| 5,406,449 | A * | 4/1995 | Hicks et al. | 361/616 |
| 5,603,638 | A * | 2/1997 | Brown et al. | 439/606 |
| 6,168,443 | B1 * | 1/2001 | Mullen et al. | 439/106 |
| 8,193,459 | B2 * | 6/2012 | Abroy | 200/17 R |
| 2010/0282578 | A1 | 11/2010 | Abroy | |

* cited by examiner

*Primary Examiner* — Gary F. Paumen
(74) *Attorney, Agent, or Firm* — Eckert Seamans Cherin & Mellott, LLC; David C. Jenkins

(57) ABSTRACT

Apparatus, systems, and methods associated with a disconnect pullout handle for selectively conducting power between jaw connectors are provided. In one embodiment, the disconnect pullout handle includes a molded handle base and a conductive blade configured for frictional engagement with the jaw connectors to provide a current path therebetween. The conductive blade is molded integrally into the blade retaining finger.

14 Claims, 5 Drawing Sheets

DISCONNECT PULLOUT HANDLE

BACKGROUND

Disconnect units are often employed in building wiring systems. A disconnect unit typically includes a dedicated enclosure that houses a disconnect device for disabling one or more selected electrical circuits. For example, a disconnect unit may house conductors that are part of an electrical circuit that provides power to an air conditioner, a refrigeration unit, or other equipment that draws electrical power. The disconnect device is used to disconnect power from the electrical circuit so that equipment powered by the circuit may be serviced safely. Thus, the disconnect unit may include locking features, such as a lockable enclosure door, that enable the service personnel to disconnect the electrical power to a circuit and then lock the unit to prevent other personnel from re-connecting power to the circuit.

SUMMARY

In one embodiment, an apparatus for selectively conducting power between at least two jaw connectors is provided. The apparatus includes a molded handle base and a conductive blade. The molded handle base includes a face portion and a blade retaining finger protruding from the face portion. The conductive blade includes at least one finger engagement portion that is integrally molded into the blade retaining finger. The conductive blade includes at least two connection portions configured for frictional engagement with the two jaw connectors to provide a current path therebetween.

In some embodiments, the integral mold between the blade retaining finger and the finger engagement portion may be the only mechanical connection between the conductive blade and the molded handle base. In some embodiments, the finger engagement portion includes at least one flow hole through which moldable material of the molded handle base flows to retain the conductive blade in the blade retaining finger. The apparatus may include two blade retaining fingers and two conducting blades, such that each blade retaining finger retains one conducting blade. In some embodiments, the conducting blade spans a central portion of the blade retaining finger without extending beyond the blade retaining finger.

In another embodiment, an electrical disconnect system is provided that includes an enclosure. A handle receiver assembly is mounted within the enclosure. The handle receiver assembly includes at least two conductive lugs that are configured to connect to electrical conductors and are electrically connected to two jaw connectors, respectively. The electrical disconnect system also includes a pullout handle assembly and a conductive blade. The pullout handle assembly includes a molded handle base having a face portion and a blade retaining finger protruding from the face portion. The conductive blade includes at least one finger engagement portion that is molded integrally into the blade retaining finger. The conductive blade includes at least two connection portions configured for frictional engagement with the two jaw connectors to provide a current path therebetween.

The electrical disconnect system may include a lid configured to be locked to the enclosure to prevent access to an interior of the enclosure. In some embodiments, the handle receiver assembly includes two sets of jaw connectors and the pullout handle assembly includes two blade retaining fingers and two conducting blades such that each blade retaining finger retains one conducting blade.

In one embodiment, a method includes molding a molded handle base having a face portion and a blade retaining finger protruding from the face portion. The method also includes integrally molding a conductive blade into the blade retaining finger. The conductive blade includes at least one finger engagement portion that is integrally molded into the blade retaining finger and at least two connection portions configured for frictional engagement with two jaw connectors, respectively, to provide a current path therebetween.

In some embodiments, the molding is performed using insert-molding techniques. The method may include causing melted handle base material to flow through at least one flow hole in the finger engagement portion to retain the conductive blade in the blade retaining finger. The conducting blade may be integrally molded into the blade retaining finger such that the conducting blade spans a central portion of the blade retaining finger without extending beyond the blade retaining finger.

BRIEF DESCRIPTION OF THE DRAWINGS

The accompanying drawings, which are incorporated in and constitute a part of the specification, illustrate various systems, methods, and other embodiments of the disclosure. One of ordinary skill in the art will appreciate that in some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1:
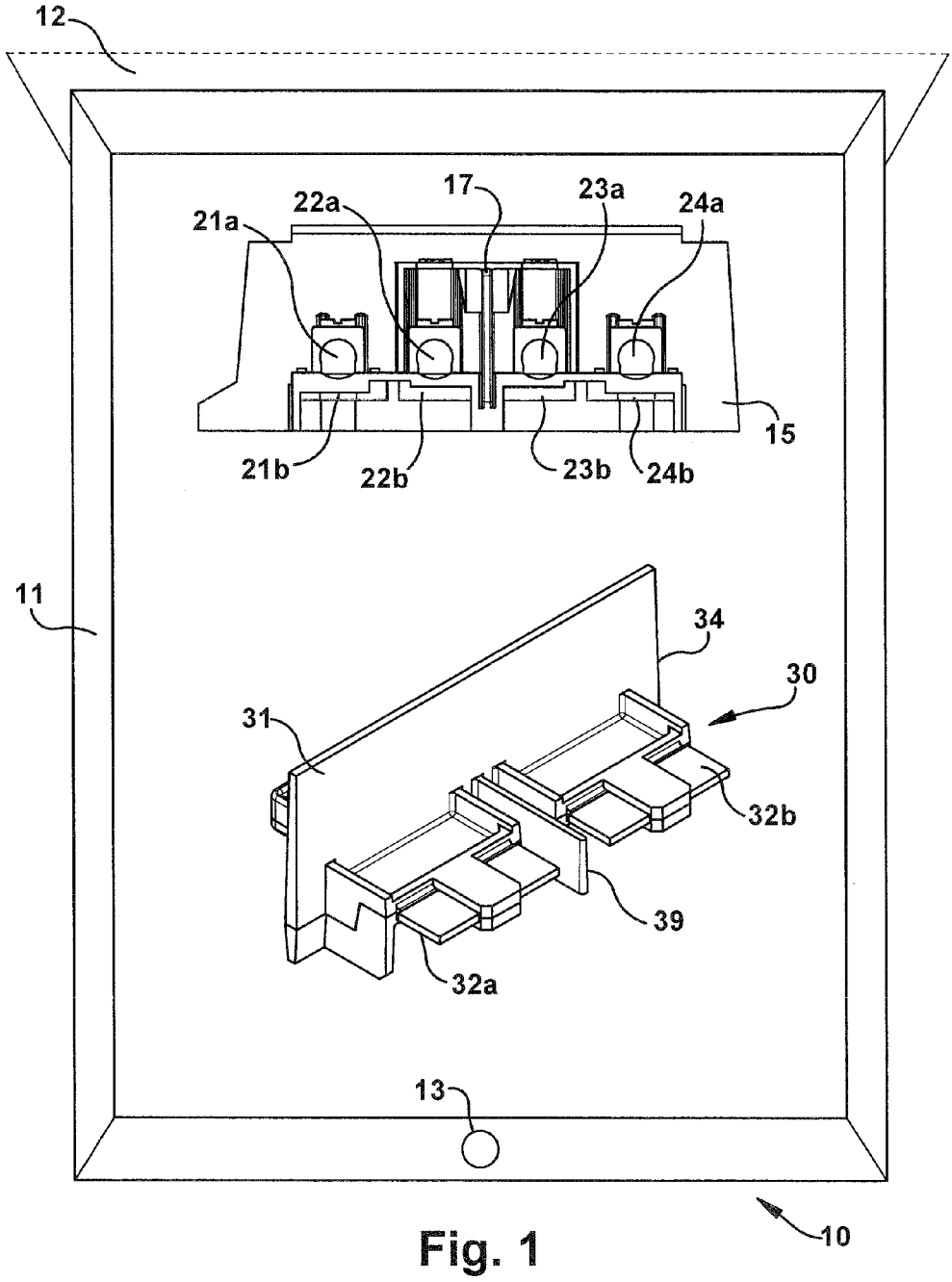
FIG. 1 is a front view of a disconnect unit that includes one example embodiment of a disconnect pullout handle.

Referring to FIG. 1, a disconnect unit 10 is shown that includes one example embodiment of a disconnect pullout handle assembly 30. The disconnect unit 10 shown in FIG. 1 includes an enclosure 11 coupled to a lid 12 that can be locked to the enclosure to prevent access to the components within the enclosure. A lock mounting flange 13 on the enclosure 12 has a hole that aligns with a corresponding hole (not shown) on the lid 13. When the holes are aligned, a lock may be inserted in the hole to secure the lid 12 to the enclosure 11. As discussed in the Background, service personnel may lock the lid to the enclosure to prevent others from reconnecting the electrical power to a device they are servicing. The particular disconnect unit 10 shown in FIG. 1 is an air conditioning disconnect unit, however the present invention can be practiced in any device that selectively interrupts power on an electrical circuit.

A handle receiver assembly 15 includes four lug connectors 21-24 that are electrically insulated from one another. Each lug connector includes a lug 21*a*-24*a* and a jaw connector 21*b*-24*b*. In this particular disconnect unit 10, the lugs 21*a* and 22*a* are configured to be connected in series with a conductor that provides electrical power to a first phase of the air conditioning circuit. The lug 21*a* is connected to an output portion of the conductor while the lug 22*a* is connected to an input portion of the conductor. The lugs 23*a* and 24*a* are configured to be connected in series with a conductor that provides electrical power to a second phase of the air condition circuit. The lug 23*a* is connected to an input portion of the conductor while the lug 24*a* is connected to an output portion of the conductor.

Figure 2:
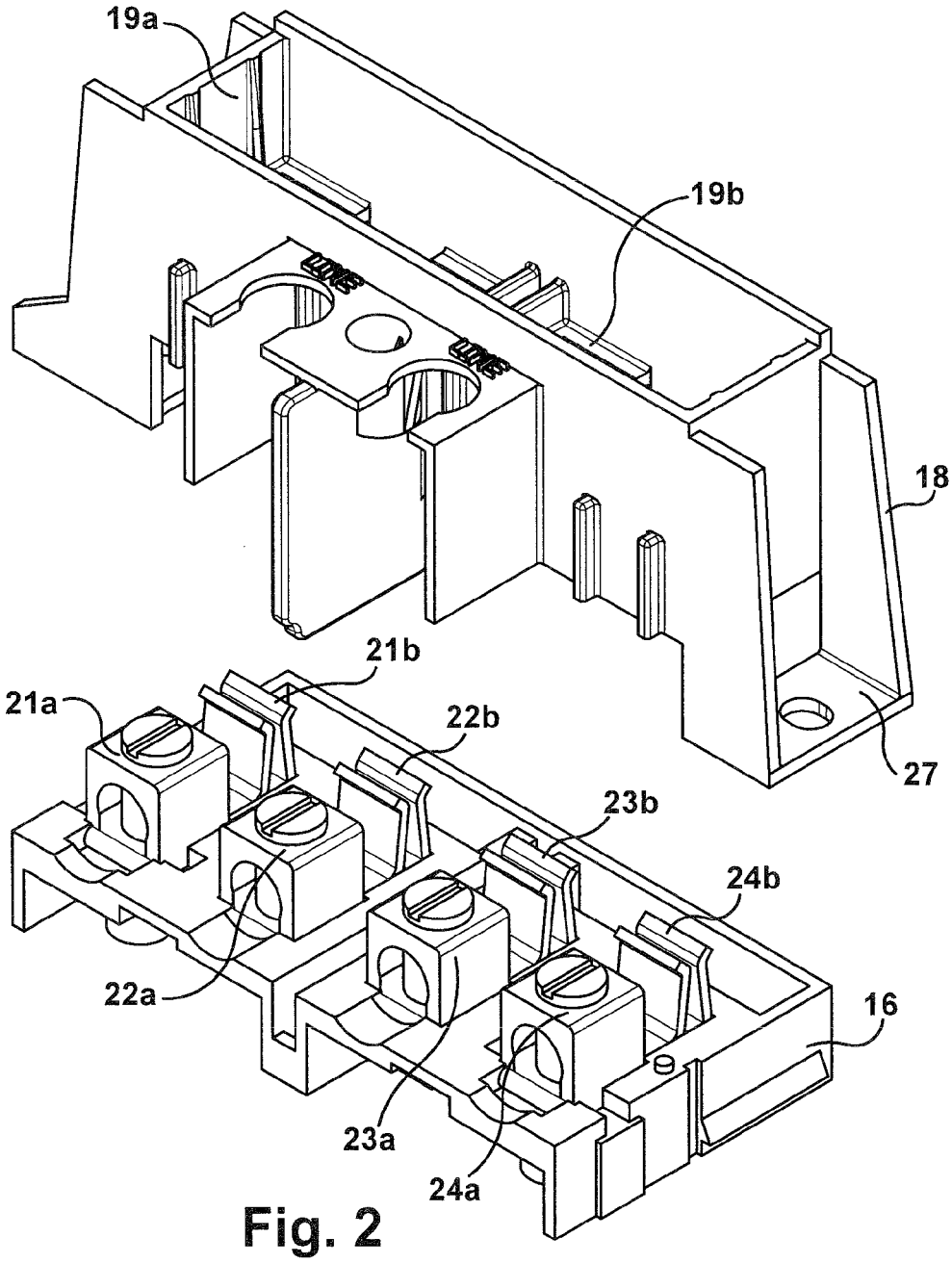
FIG. 2 is an exploded view of pullout handle receiver components.

The jaw connectors 21*b* and 22*b* , which can be seen better in FIG. 2, are configured to frictionally engage a conductive blade 32*a* on the disconnect pullout handle assembly 30. The jaw connectors 23*b* and 24*b* are configured to frictionally engage a conductive blade 32*b* on the disconnect pullout handle assembly.

In FIG. 1, the disconnect pullout assembly 30 is shown pulled away from engagement with the handle receiver assembly 15 and rotated so that the conductive blades 32*a*, 32*b* are visible. The disconnect pullout assembly 30 includes a molded handle base 34 that is integrally molded with the conductive blades 32*a*, 32*b*. The molded handle base 34 is molded of a suitable plastic material, such as, for example a polyphenylene/polystyrene based compound.

The molded handle base 34 includes a face portion 31 that carries a grip portion 38 (visible in FIGS. 3B and 4A-4E) that is grasped by a user when removing or inserting the disconnect pullout handle 30 from the handle receiver assembly 15. The molded base 34 includes a fin-shaped handle locator 39 that is configured to be inserted into a locator slot 17 to properly locate the disconnect pullout assembly 30 with respect to the receiver assembly 15. When the disconnect pullout assembly 30 is inserted into the handle receiver assembly 15, the conductive blade 32*a* is engaged by the jaw connectors 21*b* and 22*b* to complete the circuit for the first phase of the air conditioning circuit and the conductive blade 32*b* is engaged by the jaw connectors 23*b* and 24*b* to complete the circuit for the second phase of the air conditioning circuit.

FIG. 2 shows the handle receiver assembly 15 partially disassembled. The handle receiver 15 is assembled from a base 16 and a cover 18. When the handle receiver 15 is assembled, a fin-shaped connector 17 on the cover 18 rests within a connector slot in the base 16 to align the cover 18 with the base 16. The lug connectors 21-24 are visible in their entirety, with each lug including a lug 21*a*-24*a* electrically connected to a jaw connector 21*b*-24*b*, respectively.

Relevant features of the cover 18 include jaw access slots 19*a*, 19*b* into which the jaw connectors 21*b*-24*b* protrude when the cover 18 is installed on the base 16. The jaw access slot 19*a* houses jaw connectors 21*b* and 22*b* while the jaw access slot 19*b* houses jaw connectors 23*b* and 24*b*. The jaw access slots 19*a*, 19*b* are electrically insulated from one another in the cover 18 to prevent arcing between the first and second air conditioning circuit. A mounting flange 27 on the cover 18 is used to secure the handle receiver assembly 15 to an enclosure (FIG. 1).

Figure 3A:
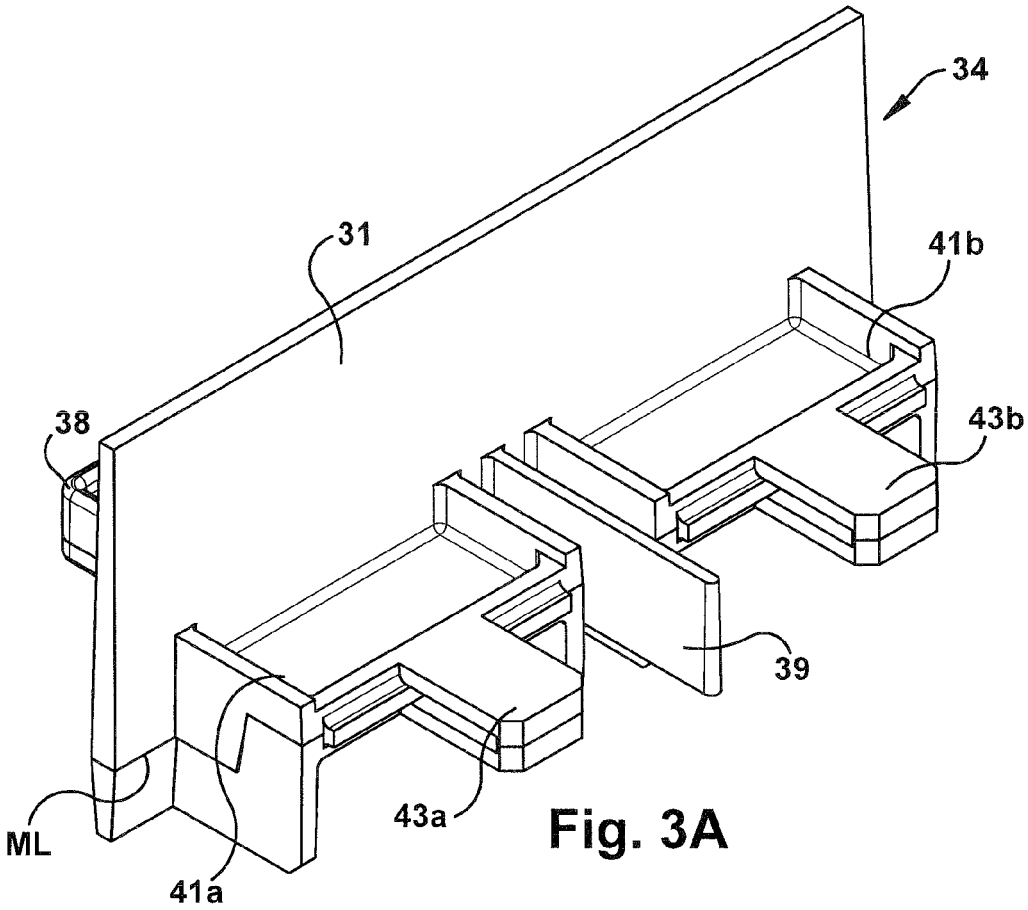
FIG. 3A is a perspective view of an example embodiment of a pullout handle base.

FIG. 3A is a perspective view of the molded handle base 34 without the conductive blades. The molded handle base 34 includes blade retaining fingers 43*a*, 43*b* that are integrally molded with the conducting blades 32*a*, 32*b*, (not shown) respectively. The molded handle base 34 also includes blade spacers 41*a*, 41*b* that position the blade retaining fingers 43*a*, 43*b* and conducting blades 32*a*, 32*b* away from the face portion 31. In the illustrated embodiment, the face portion 31, handle locator 39, spacers 41*a*, 41*b*, and blade retaining fingers 43*a*, 43*b* are all molded as a single unit. A mold line "ML" can be seen in FIG. 3A that indicates one possible molding scheme for the molded handle base 34. However, in other embodiments, these various components of the molded handle base 34 may be connected to one another in other ways so long as the conducting blades 32*a*, 32*b* are integrally molded with the blade retaining fingers 43*a*, 43*b*.

Figure 3B:
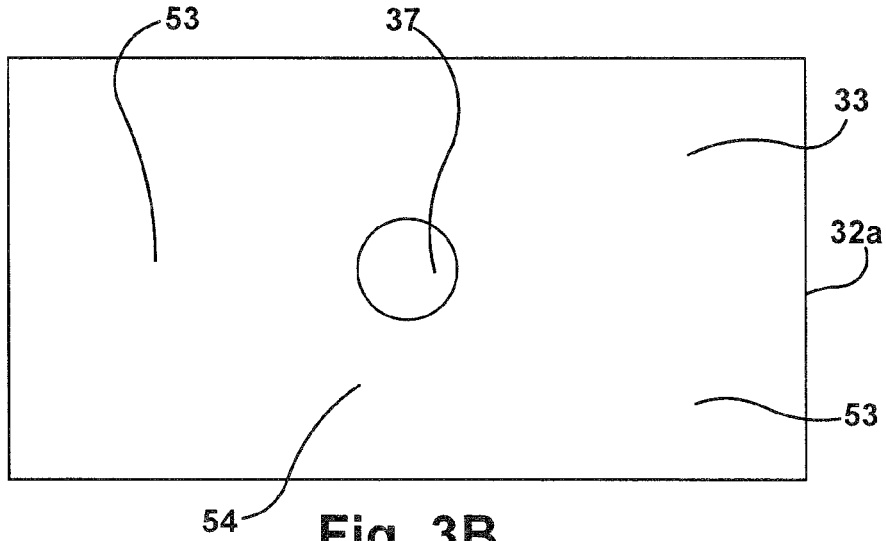
FIG. 3B is a perspective view of an example embodiment of a pullout handle blade.

FIG. 3B illustrates the blade connector 32*a*, which in this particular embodiment is identical to the blade connector 32*b*. The blade connector 32*a* includes a conductive plate 33 made of a conductive material, such as, for example, copper. The conductive plate 33 includes two connection portions 53 at either end that are configured to be received by the jaw connectors 21*b*-24*b*. A finger engaging portion 54 is located between the connection portions 53. The finger engaging portion 54 is adapted to be integrally molded with the blade retaining finger 43*a*. In the illustrated embodiment, the finger engagement portion includes a flow hole 37 through which the material of the molded handle 34 (FIG. 3A) may flow. Other configurations of the connection portions 53 and finger engaging portion(s) may be used, depending on the specific configuration of the jaw connectors 21*b*-24*b* (FIG. 2).

In some embodiments, the blade connector 22 may not include a flow hole 37. In those embodiments the blade connector 32*a*, 32*b* may be retained in the molded handle 34 by virtue of moldable material 44*a*, 44*b* (FIG. 3A) wrapping around an edge of the finger engaging portion. In the embodiments illustrated herein, the blade connector 32*a*, 32*b* is retained in the molded handle by both moldable material in the flow hole 37 and the wrapping of moldable material 44*a*, 44*b* around an edge of the blade connector. Of course, either feature individually may sufficiently retain the blade connector.

Figure 4A:
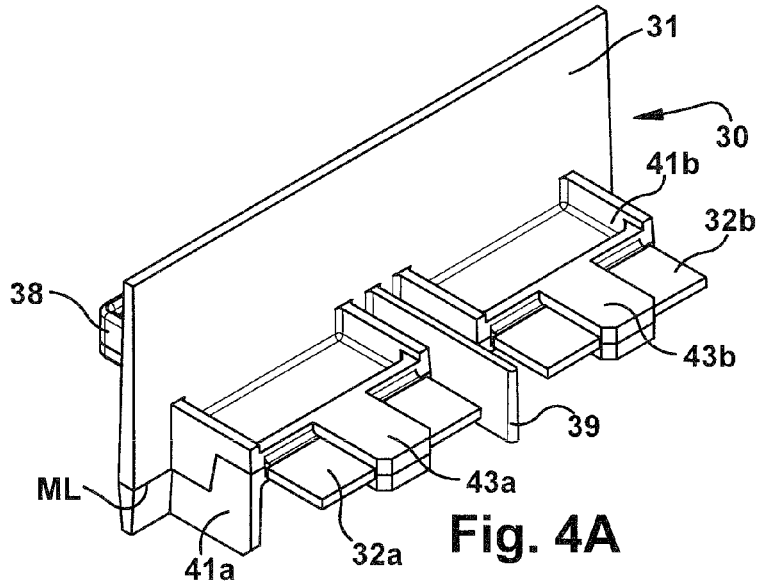
FIGS. 4A-4F are various views of the disconnect pullout handle of FIGS. 1 and 2.

FIGS. 4A-4F show the pullout handle assembly 30 in various orientations. FIG. 4A is a front perspective view in which the integral molding of the blades 32*a*, 32*b* in the blade retaining fingers 43*a*, 43*b* can be appreciated. The integral mold between the blades 32*a*, 32*b* and the retaining fingers 43*a*, 43*b* is the sole means of connection of the blades to the pullout handle assembly 30.

Figure 4B:
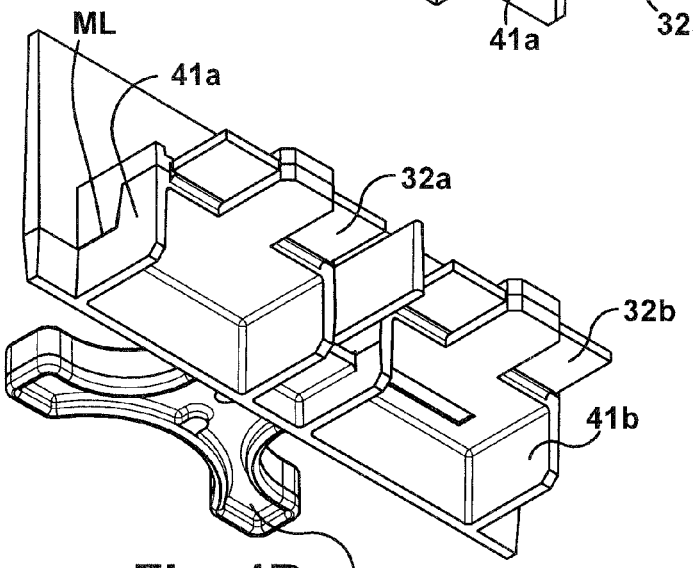
Figure 4C:
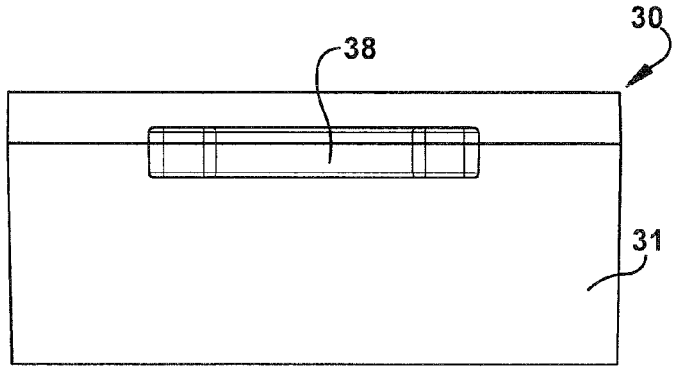
Figure 4D:
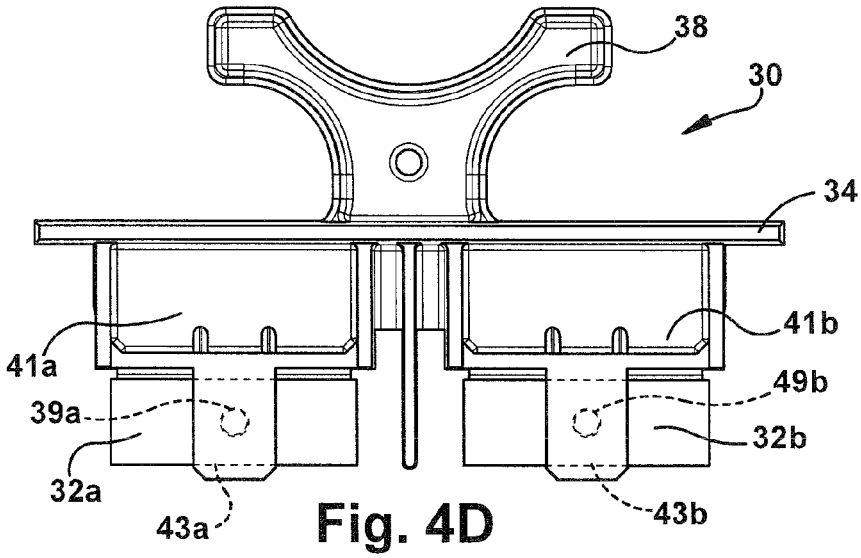

FIG. 4B provides is a perspective view that illustrates the pullout handle assembly 30 from below. The grip portion 38 can be seen as well as the configuration of the spacers 41*a*, 41*b*. FIG. 4C is a rear plan view of the pullout handle assembly 30. The face 31 and grip portion 38 are visible in this view. FIG. 4D is a top plan view of the pullout handle assembly 30. In this view it can be appreciated that the conductive blades 32*a* and 32*b* span a central portion 49*a*, 49*b* of the blade retaining fingers 43*a*, 43*b* without extending beyond the retaining fingers in any direction. Thus, the conductive blades 32*a*, 32*b* do not extend into the spacers 41*a*, 41*b*. This configuration conserves the relatively expensive material (e.g., copper) of the conductive blades.

Figure 4E:
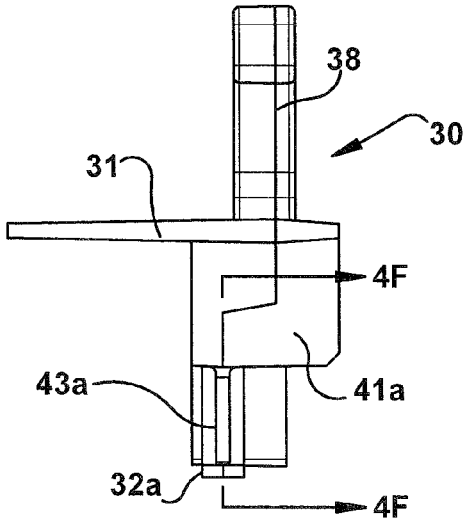
Figure 4F:
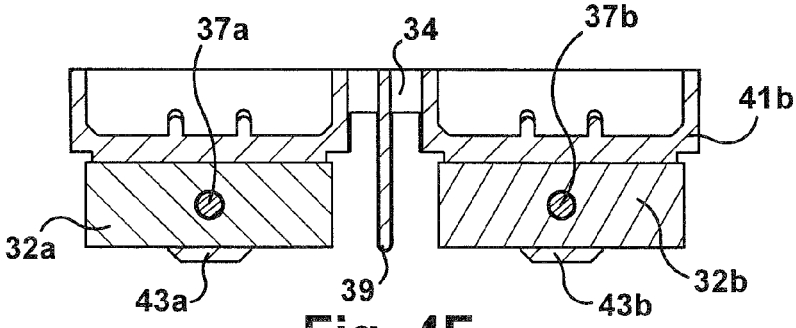

FIG. 4E is a side plan view of the pullout handle assembly 30 that shows cross section lines F-F. The cross section F-F shows in more detail the integral mold between the blade retaining fingers 43*a*, 43*b* and the conductive blades 32*a*, 32*b*. Molded material of the molded base 34 flowed through the holes 37*a*, 37*b* to retain the blades within the blade retaining fingers.

In one embodiment, the integral mold between the conductive blades 32*a*, 32*b* and the blade retaining fingers 43*a*, 43*b* is achieved using insert molding. Using insert molding allows for the installation of the blades 32*a*, 32*b* within the pullout handle assembly 30 during the same molding operation. This eliminates the need for additional fasteners to fix the blades within the pullout handle assembly or any separate assembly operations to otherwise fix the blades within the pullout handle. The amount of copper used for the blades can be reduced to that required to carry the current load instead of sizing the blades so that they can be fastened to the pullout handle assembly.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

What is claimed is:

1. An apparatus for selectively conducting power between at least two jaw connectors comprising:

a molded handle base comprising a face portion and a blade retaining finger protruding from the face portion;

a conductive blade including at least two connection portions configured for frictional engagement with the two jaw connectors to provide a current path therebetween; and where the conductive blade includes at least one finger engagement portion that is integrally molded into the blade retaining finger.

2. The apparatus of claim 1, where the integral mold between the blade retaining finger and the finger engagement portion is the only mechanical connection between the conductive blade and the molded handle base.

3. The apparatus of claim 1 where the finger engagement portion comprises at least one flow hole through which moldable material of the molded handle base flows to retain the conductive blade in the blade retaining finger.

4. The apparatus of claim 1 where the finger engagement portion comprises edges of conductive blade that are captured by moldable material of the blade retaining finger.

5. The apparatus of claim 1 comprising two blade retaining fingers and two conducting blades, where each blade retaining finger retains one conducting blade.

6. The apparatus of claim 1 where the conducting blade spans a central portion of the blade retaining, finger without extending beyond the blade retaining finger.

7. An electrical disconnect system comprising:

an enclosure;

a handle receiver assembly mounted within the enclosure, the handle receiver assembly comprising at least two conductive lugs configured to connect to electrical conductors, the conductive lugs electrically connected to two jaw connectors, respectively; and a pullout handle assembly comprising:

a molded handle base comprising a face portion and a blade retaining finger protruding from the face portion;

a conductive blade including at least two connection portions configured for frictional engagement with the two jaw connectors to provide a current path therebetween; and where the conductive blade includes at least one finger engagement portion that is molded integrally into the blade retaining finger,

8. The electrical disconnect system of claim 7, comprising a lid configured to be locked to the enclosure to prevent access to an interior of the enclosure.

9. The electrical disconnect system of claim 7, where:

the handle receiver assembly comprises two sets of jaw connectors; and the pullout handle assembly comprises two blade retaining fingers and two conducting blades, where each blade retaining finger retains one conducting blade.

10. A method comprising:

molding a molded handle base comprising a face portion and a blade retaining finger protruding from the face portion; and integrally molding a conductive blade into the blade retaining finger, where the conductive blade includes at least one finger engagement portion that is integrally molded into the blade retaining finger and at least two connection portions configured for frictional engagement with two jaw connectors, respectively, to provide a current path therebetween.

11. The method of claim 10 where the molding comprises insert-molding.

12. The method of claim 10 comprising, causing melted handle base material to flow through at least one flow hole in the finger engagement portion to retain the conductive blade in the blade retaining finger.

13. The method of claim 10 comprising causing melted handle base material to flow around edges of the finger engagement portion to retain the conductive blade in the blade retaining finger.

14. The method of claim 10 comprising integrally molding the conducting blade into the blade retaining finger such that the conducting blade spans a central portion of the blade retaining finger without extending beyond the blade retaining finger.

* * * * *